US005999783A

United States Patent [19]

Folkins

[11] Patent Number: 5,999,783

[45] Date of Patent: Dec. 7, 1999

[54] MULTIPLE CHARGING OF A TONER IMAGE FOR TRANSFER

[75] Inventor: Jeffrey J. Folkins, Rochester, N.Y.

[73] Assignee: Xerox Corporation, Stamford, Conn.

[21] Appl. No.: 09/213,476

[22] Filed: Dec. 17, 1998

[51] Int. Cl.[6] ..... G03G 15/16

[52] U.S. Cl. ..... 399/296; 399/231; 399/232

[58] Field of Search ..... 399/296, 149, 399/150, 66, 297, 298, 39, 40, 231, 232

[56] References Cited

U.S. PATENT DOCUMENTS 5,778,289 7/1998 Folkins ..... 399/231

*Primary Examiner*—Arthur T. Grimley
*Assistant Examiner*—Hoan Tran
*Attorney, Agent, or Firm*—Reid K. Cunningham

[57] ABSTRACT

An electrophotographic machine has a photoreceptive member supporting a composite color toner image formed of multiple layers of different colored toners. The composite toner image is pre-transfer charged at a first voltage level and recharge at a second voltage level less than the first voltage level. The background toner is preferentially charged by the second charging to reduce transfer of the background toner to the substrate.

16 Claims, 2 Drawing Sheets

MULTIPLE CHARGING OF A TONER IMAGE FOR TRANSFER

FIELD OF THE INVENTION

This invention relates to electrophotographic-printing machines and more particularly to the charging of the photoreceptive member of an electrophotographic-printing machine for transfer of the toner image to a substrate.

BACKGROUND OF THE INVENTION

Electrophotographic marking is a well-known and commonly used method of copying or printing documents. Electrophotographic marking is performed by exposing a light image representation of a desired document onto a substantially uniformly charged photoreceptive member. In response to exposure by the light image representation, the photoreceptive member discharges so as to create an electrostatic latent image of the desired document on the surface of the photoreceptive member. A development material having toner is then deposited onto the electrostatic latent image so as to form a toner image. That toner image is then transferred from the photoreceptor onto a substrate, such as a sheet of paper. The transferred toner image is then fused to the substrate to form the completed document. Fusing of the toner image to the substrate is typically accomplished by a combination of heat and/or pressure. The surface of the photoreceptive member is then cleaned of residual developing material and recharged in preparation for the production of another document.

Multicolor images by electrophotographic marking can be produced by repeating the above described process once for each color of toner that is employed to form the composite toner image. For example, in one color process referred to herein as the REaD process (recharge expose and develop), a charged photoreceptive surface is exposed to a light image which represents the first component color of a composite color image. The composite color image is produced from a composite toner image of four layers of toner, the first typically being black, followed by magenta, yellow, and cyan. The resulting first electrostatic latent image is then developed with black toner particles to produce the black toner layer for the composite toner image. The charge, expose and develop process is then repeated to form a toner layer of the second component color of the composite color image. In an image-on-image process color (IOI), the subsequent component toner layers may overlay the previous component toner layers to thereby form a full spectrum of colors by their interaction. Alternately, the process can involve image-next-to-image (INI) wherein the component toner layers are positioned adjacent each other. Image-next-to-image is typically employed, for example, in highlight color printing. The INI process typically has two color toners wherein one component color is the highlight on the document. However, the INI process can clearly be implemented with additional color toners. In the IOI process, the color toner particles of the component toner layers are placed in a superimposed registration so that the desired composite color images are formed. The composite toner image in either the Read IOI process or REaD INI process is then transferred from the photoreceptive member and onto the substrate.

The REaD IOI and REaD INI processes can be implemented in a variety of configurations of an electrophotographic printing machine. In a single pass printing arrangement, the final composite toner image is produced in a single pass of the photoreceptive member through a printing machine having multiple charging development and exposure stations. Typically, four charging stations and four exposure stations are implemented to recharge, expose and develop each component color toner layer of the desired final four color composite toner image. Alternately in a multiple pass arrangement, the photoreceptive member cycles past a single charging station, a single exposure station, and multiple development stations. The photoreceptive member typically will cycle four times, one cycle for each component toner layer. In either configuration of an electrophotographic-printing machine, the composite toner image is subsequently transferred from the photoreceptive member to the substrate in a single step. The transfer can be directly to the substrate or via an intermediate toner support member such as a belt or drum.

The above described processes for single or multiple pass electrophotographic marking are not mutually exclusive but can be combined in various configurations. For example, a printing machine can have two charging stations and four developing stations. Two toner layers are added at each cycle of the photoreceptive member to result in a final four-color composite toner image in two cycles of the photoreceptive member.

Background print quality defects can be a serious problem with any color print architecture which requires recharge of the photoreceptive member. Recharge of the photoreceptive member occurs between development stages and also occurs during pre-transfer charging of the toner image on the photoreceptive member. In conventional electrophotographic systems, the non-image or non-developed image areas of the toner image typically have at least a small quantity of unwanted background toner developed onto them. Transfer of this background toner to the substrate results in the unwanted background print quality defects. The background toner is usually extensively of opposite polarity from the developed image area toner. This opposite polarity or wrong-sign toner can arise from aging toner, the charging processes or other actions that occur in the toner sump. In monochromatic electrophotographic systems, the wrong-sign background toner typically does not transfer effectively from the photoreceptive member to the substrate. The transfer charge treatment of the substrate in a monochromatic system is of a particular polarity that the substrate attracts the image area toner but repels the wrong-sign background toner developed in the background areas of the toner image.

The recharging of the photoreceptive member in for example the REaD IOI process between development stages, delivers the same charge polarity to the image and non-image or background areas. This recharging causes all the toner, both in the desirable image areas and in the background areas, to take on the same charge polarity. The charging of all the toner on the photoreceptive member with the same polarity, regardless of location also occurs during pre-transfer charging to prepare the toner image for transfer to the substrate. In either the recharge step or pre-transfer charge step, the wrong-sign background toner is recharged to the same polarity as that of the image toner resulting in transfer of the background toner along with the image toner to the substrate. This background toner transfer degrades print quality.

Toner splatter is an additional print quality defect that can occur from the REaD/IOI process. Toner splatter occurs when highly charged toners are developed on top of multiple layers of previously developed toners. Fringe fields are generated between the top most toner and the photoreceptor that pull or drive the toner particles in the top most toner layer from their preferred location. The toner particles in the top most toner layer move from the top toner layer along the electric field and onto the background areas surrounding the image area. The result of the movement of the toner particles of the top most toner layer is a bleeding or halo of the color of the top most toner layer onto the photoreceptive member surrounding the preferred composite toner image.

SUMMARY OF THE INVENTION

Briefly stated, the invention is an apparatus and process having pre-transfer charging of a toner image to reduce background print quality defects. The preferred embodiment employs an electrophotographic printing device, but is additionally applicable for related technologies including electron beam imaging or other non-direct marking technologies. The preferred electrophotographic printing apparatus in accordance with the invention sequentially moves a photoreceptive member past a charging station, an exposure station, multiple developer stations, a transfer station, and finally a cleaning station prior to returning to the charging station. Each of the multiple developer stations preferably develops a layer of a different color toner onto the photoreceptive member. These typical colored toners include black, yellow, magenta and cyan each in an individual developer station.

In operation of the electrophotographic-printing machine in accordance with the invention, the photoreceptive member is uniformly charged at the charging station. The charged or image area of the photoreceptive member is then moved to the exposure station. The image area is exposed to a light image representation of a first color component of the desired final composite color image. The exposure of the charged image area to the light image representation forms a first electrostatic latent image. The first electrostatic image is formed of an exposed or discharged area having a first charge level and an unexposed area having a second charge level. The first electrostatic latent image is then developed with the first colored toner particles by the corresponding development station to produce the first toner image. The charge, expose and develop process is repeated for each of the colored toners at each of the corresponding developer stations. In the preferred form, the photoreceptive member is recharged and developed to result in the preferred four toner layers of black, yellow, magenta and cyan. The four toner layers form the composite toner image.

The composite toner image is split pre-transfer charged at the pre-transfer station prior to transfer of the composite toner layer to a substrate. The pre-transfer charge assists in the transfer of the composite toner image from the photoreceptive member to the substrate. The substrate is typically paper but can also include transparencies, intermediate belts, rollers or other toner support surfaces. The split pre-transfer charging has an initial pre-transfer charge applied to the composite toner image, followed by a secondary pre-transfer charge applied to the composite toner image.

The toner composite image will typically have toner solid areas that are desirable to transfer to the substrate. The composite toner image will further have background toner particles in the background portions of the image that are undesirable to transfer to the substrate. At the pre-transfer charging station, an initial charging device, preferably a corotron or scorotron applies a generally uniform initial pre-transfer charge or voltage to the composite toner image on the photoreceptive member. The composite toner image is subsequently charged with a secondary pre-transfer charge or voltage by a secondary pre-transfer charge device such as a corotron or a scorotron. The secondary pre-transfer charge applied is less than the initial pre-transfer charge by preferably a few hundred volts, and hence charges the image with opposite polarity charges as compared with the initial pre-transfer charger. The secondary pre-transfer charge preferentially charges the isolated background toner particles relative to the toner in the desirable solid body areas of the composite toner image. The secondary pre-transfer treatment of a few hundred volts difference reduces the transfer performance of the isolated background toner to the substrate while not seriously degrading the clump or clustered image dot transfer of the preferred solid body portions of the composite toner image to the substrate. This is because due to the geometry, the electrostatic fields emanating from isolated toner particles tend to focus more of the secondary charges onto themselves than the clustered images. The charging of the composite toner image by the primary and secondary pre-transfer charging devices forms a split pre-transfer charged composite toner image. The split pre-transfer charged composite toner image is then conventionally transferred to the substrate.

In a further embodiment of the invention, the pre-transfer charging station has a single charging device such as a corotron or scorotron for placing both the initial pre-transfer charge and the secondary pre-transfer charge on the composite toner image. The photoreceptive member having the composite toner image is cycled twice past the single charging device of the pre-transfer charging station. The single pre-transfer charging device applies the initial pre-transfer charge to the composite toner image on the first cycle of the photoreceptive member. The same pre-transfer charging device is then reset to apply the relatively reduced secondary pre-transfer charge to the composite toner image on the second cycle of the photoreceptive member.

In a further embodiment of the invention, the photoreceptive member additionally cycles and the secondary split pre-transfer charge is applied by a charging device associated with the charging station or other conventional well-known charging locations around the photoreceptor.

In a still further embodiment of the invention, the electrophotographic printing apparatus is operated whereby the split pre-transfer charging is selectively implemented based on operational parameters. Selective implementation of the invention is preferable in certain operational environments. Split pre-transfer charging reduces transfer of unwanted background toner particles but can also under certain conditions result in some degradation of the print quality of the desirable solid body toner areas. Therefore, in certain operational environments it is preferable to only selectively implement split pre-transfer charging when transfer of background toner is unacceptably above a preselected threshold. A sensor is employed to monitor the level of transfer of the background toner particles to the substrate. When the level of background toner transfer exceeds the preselected threshold, the split pre-transfer charging is implemented to reduce the background toner transfer below the preselected threshold. Alternately, a set of preselected operational parameters are monitored whereby occurrence of conditions outside of the preselected operational parameters results in selective implementation of the split pre-transfer charging of the invention. For example, when humidity, temperature or other conditions are measured at levels that will typically produce increased background toner transfer, the split pre-transfer charging is implemented to again reduce the level of background toner transfer below the preselected limit.

DETAILED DESCRIPTION OF A PREFERRED EMBODIMENT OF THE INVENTION

Figure 1:
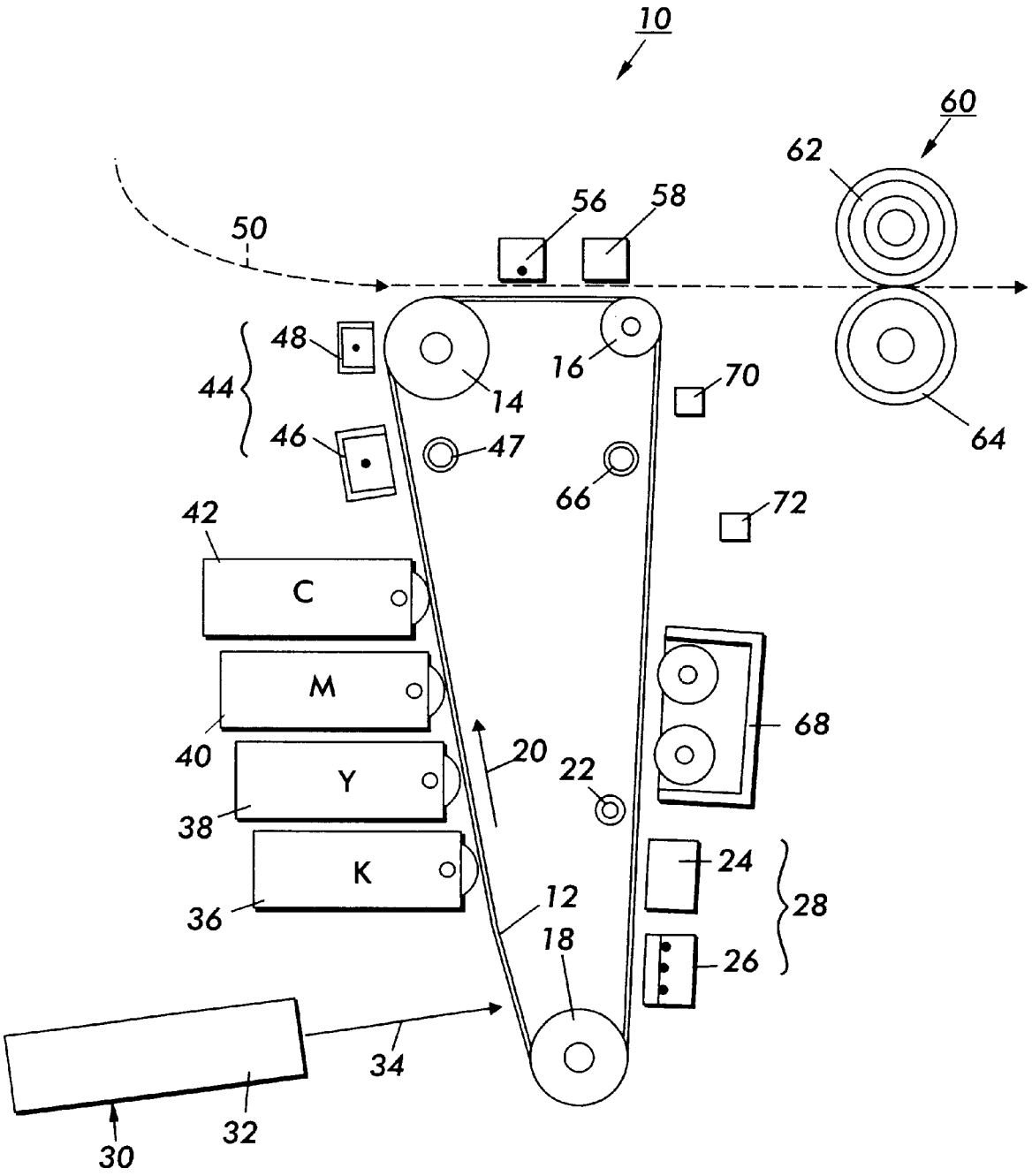
FIG. 1 is a schematic side view of an electrophotographic printing apparatus in accordance with the invention.

With reference to FIG. 1, an electrophotographic printing apparatus in accordance with the invention preferably operates to produce a composite color image in four passes or cycles of a photoreceptive member 12. The photoreceptive member 12 is preferably formed of an active matrix photoreceptor belt, or can alternately be formed of a photoreceptive drum or other well-known structures. The photoreceptive member 12 is driven around a cyclical path or loop on first and second tension rollers 16, 18 by a drive roller 14. The photoreceptive member 12 moves in the closed cyclical path having a process direction indicated by the arrow 20. For purposes of discussion, a single section of the photoreceptive member 12 is identified as the image area. The image area is that part of the photoreceptive member 12 which receives the various processes by the stations positioned around the photoreceptive member 12. The photoreceptive member 12 may have numerous image areas, however each image area is processed in the same way.

The production of a color document takes place in preferably four cycles or rotations of the photoreceptive member 12. The first cycle begins with the image area of the photoreceptive member 12, moving in the process direction past a pre-charge erase lamp 22. The pre-charge erase lamp 22 luminates the image area so as to discharge any residual charge in the photoreceptor material of the photoreceptive member 12.

The image area of the photoreceptive member 12 is next moved in the process direction past a charging station 28 for application of a generally uniform charge to the image area. The charging station 28 has a DC scorotron 24 and an adjacent AC scorotron 26. The DC scorotron 24 and AC scorotron 26 together prepare the image area for exposure by a photo source to create a latent image. The DC scorotron 24 charges the image area to a substantially uniform potential of, for example, about 500 volts. The AC scorotron 26 is not required for use during the initial charging of the image area, but when preferably operated in combination with the DC scorotron 24, provides an improved charge uniformity on the photoreceptive member 12 at the image area.

The image area then advances in the process direction to an exposure station 30. The exposure station 30 preferably has a laser 32 producing a modulated laser beam 34. The exposure station 30 raster scans the modulated laser beam 34 onto the charged image area. The laser beam 34 exposes a light image representation of one color component of the composite color image onto the image area to form a first electrostatic latent image. In an example, illuminated sections of the image area are discharged by the modulated laser beam 34 to −50 volts. The exposure of the image area forms therefore the first electrostatic latent image having a generally two level voltage profile. The voltage profile has relatively high voltage unexposed areas at about −500 volts, and relatively low voltage exposed areas at about −50 volts.

The image area is then moved again in the process direction to the group of first, second, third and fourth developer stations 36, 38, 40, 42. The first, second, third and fourth developer stations 36, 38, 40, 42 preferably correspond to the four basic color components, black, yellow, magenta and cyan, that are employed to form a complete full range color composite toner image. Each of the first, second, third and fourth development stations 36, 38, 40, 42 is preferably a scavengeless developer of well-known construction but other well-known developer constructions can be employed in the electrophotographic printing machine 10.

The first developer station 36 preferably develops black toner. The first developer station 36 deposits negatively charged black toner particles onto the image area containing the corresponding black component of the composite color image or first latent image. The charged toner adheres to the discharged areas of the first latent image thereby causing the voltage of the previous illuminated parts of the latent image to be about −200 volts. The on-illuminated parts of the latent image of the image area remain at −500 volts. The development of the toner into the relatively low voltage areas is described as discharge area development. The negatively charged toner is repelled from the high voltage non-exposed areas of the first latent image and adheres to the relatively lower voltage discharged areas of the first latent image.

The image area is further moved in the process direction past the additional second, third and fourth developer stations 38, 40, 42. After development by the first developer station 36, the second, third and fourth developer stations 38, 40, 42 are electrically biased or configured in order not to disturb the now-developed first toner layer. The image area then returns along the process direction to the pre-charge erase lamp 22 where the second cycle commences.

The pre-charge erase lamp 22 re-illuminates the image area to discharge any residual charge in the photoreceptive member 12 at the image area. Next, the charging station 28 by use of the DC scorotron 24 recharges the image area to a pre-established charged level. The image area is now again prepared for exposure and development of the next component toner layer of the composite toner image. The next toner layer is typically yellow, followed in order by magenta and cyan.

The recharged first toner image with its first toner layer then advances in the process direction again to the exposure station 30. The exposure station 30 exposes the image area with a light image representation of the second color component of the color composite image by use of the modulated laser beam 34. The exposure produces a second electrostatic latent image for receiving the second toner layer of the composite toner image. Typically the second latent image is for yellow toner.

The exposed image area then is advanced past the retracted first developer station 36 to the second developer station 38 for development of the second toner layer. After development of the second toner layer, the image area continues past the inactive third and fourth developer stations 40, 42 to recharge, expose and develop each of the subsequent third and fourth toner layers.

The non-imaged areas of the first toner image on the photoreceptive member will typically have unwanted toner or background toner developed onto them. This background toner may be negatively charged, or charged the same as the toner in the desirable solid body areas of the first toner image. More typically however, the background toner is extensively of opposite polarity from the toner in the solid body areas, and is therefore often described as wrong-sign toner. During the recharge process by the initial pre-transfer charge, the opposite polarity or wrong-sign background toner is blanketed with negative charge thereby changing the polarity the background toner to the same polarity as that of the toner in the desirable solid body image area. As a result, after recharging of the photoreceptive member 12 for development of additional toner layers, there is no substantial differentiation between the voltages and polarities of the toner in the desirable solid image areas and the background toner in the background areas. The addition of the final toner layer from the fourth developing station 42 completes the formation of the complete composite toner image.

At each recharge of the image area, undesirable background toner particles the composite toner image will be changed from a wrong-sign or opposite polarity to the same polarity as that of the desirable solid body toner in the composite toner image.

After development of the final toner layer by the fourth developer station 42, the image area having the composite toner image advances to the pre-transfer station 44. The pre-transfer station 44 preferably has a pre-transfer discharge lamp 47 positioned at the rear surface of the photoreceptive member 12. The pre-transfer station 44 further has a primary pre-transfer charging device 46 and adjacent secondary pre-transfer charging device 48. The primary pre-transfer charging device 46 is preferably a DC scorotron and the secondary pre-transfer charging device 48 is preferably a scorotron. The pre-transfer discharge lamp 47 discharges the photoreceptive member 12 to produce a relatively low charge level on the image area. The discharge of the photoreceptive member 12 prepares transfer of the composite toner image from the photoreceptive member 12 to a substrate 50.

The repeated charging and discharging of each component toner layer of the composite toner image and the image area typically results in non-uniformity of both charge level and charge polarity in the desired solid toner portions of the composite toner image. Therefore, in order to effectively transfer the composite toner image from the photoreceptive member 12 to the substrate 50, the entire image area is charged by the primary pre-transfer charging device 46. The primary pre-transfer charging device 46 performs a primary pre-transfer charging of the image area by supplying sufficient negative ions to the image area such that any positively charged toner particles in the desirable solid body toner portions are reversed in polarity. However, the undesirable background toner particles are also charged to the same polarity as those of the desirable solid toner image areas and will be transferred to the substrate 50 if no further processing or conditioning occurs.

The electrophotographic-printing machine 10 in accordance with the apparatus and method of the invention, then employs the secondary pre-transfer charging device 48 to charge the image area at a preselected secondary voltage. The secondary voltage applied by the secondary pre-transfer charging device 48 is lower relative to the primary voltage applied by the primary pre-transfer charging device 46. The voltage differential applied between the primary pre-transfer charging device 46 and the secondary pre-transfer charging device 48 results in a small quantity of positive ions being supplied to the image area. The positive ions emitting from the secondary pre-transfer charging device 48 are preferentially attracted to the isolated background toner particles relative to the toner particles in the solid body areas of the composite toner image. Therefore, the small amount of positive back charging resulting from the voltage differential of the primary and secondary pre-transfer charging devices 46, 48 will preferentially positively charge the background toner. Preferentially positively charging the background toner reduces the effective transfer of the isolated particles of background toner before substantially degrading transfer of the preferred toner particles of the solid body portions of the composite toner image. In other words, the back charging preferentially changes the polarity of isolated toner particles, most typically background toner, before charging the polarity of the solid toner areas such as desirable solid body areas of the composite toner image. Increases in the grid voltage differential between the primary pre-transfer charging device 46 and the secondary pre-transfer charging device 48 can substantially reduce transfer of background toner from the photoreceptive member 12 to the substrate 50.

Figure 2:
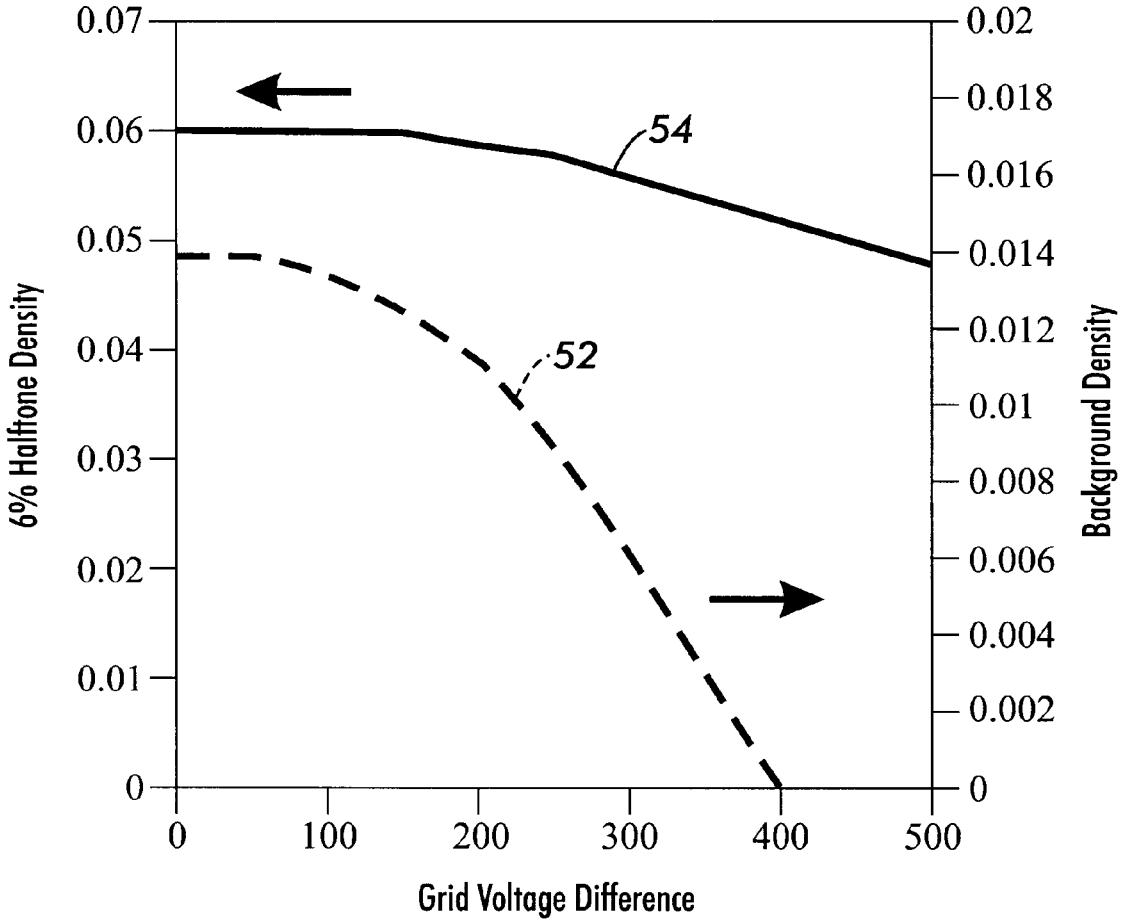
FIG. 2 is a graphical representation of Halftone Density versus Background Density for a range of Voltage Differences of split pre-transfer charging in accordance with the invention.

With reference to FIG. 2, displaying a graphical representation of toner transfer in an electrophotographic printing machine 10, the background density 52 and halftone density 54 are plotted relative to the grid voltage differential of the primary pre-transfer charging device 46 and secondary pre-transfer charging device 48. The transfer of the background toner particles or background density 52 is decreased with increasing voltage differentials between the primary pre-transfer charging device 46 and secondary pre-transfer charging device 48. At a voltage difference of 100 to 300 volts background density 52 is substantially decreased and is further eliminated at a voltage differential of 400 volts. The halftone density 54 declines with increases in the grid voltage differential, but importantly declines at a rate less than that of the reduction in background density 52.

The split pre-transfer charging in accordance with the invention also reduces toner splatter print quality defects. The reduction of charge level of the last applied toner layer by back charging reduces the tendency for fringe fields between the last applied toner layer and the photoreceptive member 12. In an electrophotographic printing apparatus operated in accordance with the invention, toner splatter was significantly reduced at voltage differentials between the primary and secondary pre-transfer charging devices 46, 48 of over 300 volts.

The substrate 50 is placed over the split pre-transfer charged composite toner image using a sheet feeder (not shown). The substrate 50 and image area are brought into contact to transfer the split pre-transfer is charged composite toner image from the photoreceptive member 12 to the substrate 50. A transfer corotron 56 applies positive ions onto the side of the substrate 50 opposite the photoreceptive member 12 to attract the negatively charged toner particles of the composite toner image onto the substrate 50 from the photoreceptive member 12. A de-tack corotron 58 then neutralizes a portion of the charge on the substrate 50 subsequent to the transfer of the composite toner image from the photoreceptive member 12 to the substrate 50. The neutralization of charge on the substrate 50 by the detack corotron 58 assists in separation of the substrate 50 from the photoreceptive member 12. The leading edge of the substrate 50 separates from the surface of the photoreceptive member 12 as the substrate 50 moves around the curve defined by the first tension roller 16.

The substrate 50, supporting the composite toner image, is then directed from the photoreceptive member 12 into a fuser assembly 60. The fuser assembly 60 has a heated fuser roller 62 and a pressure roller 64 defining a nip through which the substrate 50 passes. The substrate 50 is directed into the nip of the heated fuser roller 62 and pressure roller 64 where a combination of heat and pressure at the nip causes the composite toner image to fuse into the substrate 50 to form the final printed document. A chute (not shown) guides the substrate 50 to a catch tray (not shown) for removal by an operator after fusing.

The image area of the photoreceptive member 12 continues in the process direction and passes a pre-clean erase lamp 66. The pre-clean erase lamp 66 neutralizes most of the charge remaining at the image area of the photoreceptive member 12. A cleaning station 68 then removes the residual toner or debris from the image area. The cleaning station 68 preferably has blades to wipe the residual toner particles from the image area. The operation of the cleaning station 68 completes the four-cycle printing process. The electrophotographic printing machine 10 can thereafter begin the printing of a new composite toner image onto a substrate by re-operation of the pre-charge erase lamp 22 and the start of another four cycles.

In a further embodiment of the invention, the pre-transfer charging station an electrophotographic printing machine is constructed wherein the charging station has only a single charging device, the primary pre-transfer charging device 46. An additional cycle or full rotation of the photoreceptive member 12 is implemented whereby each complete printing operation has five rotations or cycles of the photoreceptive member 12. Therefore as described above at the end of the fourth cycle of the photoreceptive member 12 the primary pre-transfer charging device 46 charges the composite toner image at the primary pre-established charge or voltage. The photoreceptive member 12 then undergoes a full cycle to return the primary pre-transfer charged composite toner image to the primary pre-transfer charging device 46. The composite toner image is then recharged at the preselected secondary charge voltage less than the primary charge voltage to therefore implement the split pre-transfer charging. Transfer of the composite toner image from the photoreceptive member 12 to the substrate 50, and cleaning of the photoreceptive member 12 therefore occur at the end of the fifth cycle in the same manner as above-described.

In a still further embodiment of the invention, the pre-transfer charging station 44 has only a single charging device, the primary pre-transfer charging device 46 and the photoreceptive member 12 undergoes a fifth cycle as previously described. However, the second pre-transfer charging of the composite toner image is implemented by the AC scorotron 26 or other charging devices associated with the other process stations situated around the photoreceptive member 12. Both embodiments having an additional cycle of the photoreceptive member 12 fail to require additional charging devices to implement the method of the invention employing electrophotographic apparatus known in the art. Therefore these embodiments are particularly useful in operational environments where additional space around the photoreceptive member is difficult to obtain or unavailable for positioning of the secondary pre-transfer charging device 48. Typically, however, the printing rate will be decreased by the addition of the fifth cycle to the operation of the electrophotographic-printing machine 10.

In a still further embodiment of the invention, the split pre-transfer charging is selectively implemented based on operational parameters. The electrophotographic-printing machine 10 is operated in a normal four-cycle mode without the use of the secondary pre-transfer charging device 48 in order to maintain peak print quality. A background sensor 70 monitors the level of undesirable background toner particles on the composite toner image. When the quantity of background toner particles exceeds a pre-established limit, split pre-transfer charging by the secondary pre-transfer charging device 48 is implemented to reduce to an acceptable level the amount of background toner transferred to the substrate 50. Alternately, if no secondary pre-transfer charging device 48 is employed, detection of excess background toner by the background sensor 70 results in the electrophotographic printing machine 10 switching operation from a four cycle printing mode to a five cycle printing mode as described above to implement the split pre-transfer charging in accordance with the invention.

In a still further embodiment of the invention, sensors 72 detect the operational environment of the electrophotographic-printing machine 10. When the environment conditions are outside pre-established environmental operating parameters, split pre-transfer charging is implemented. For example, when the sensors 72 indicate excess humidity, heat or other factors that effect print quality therefore leading to increased background toner over a pre-established limit the split pre-transfer charging is implemented. The split pre-transfer charging is accomplished by selective operation of the secondary pre-transfer charging device 48. Alternately, the electrophotographic printing machine 10 is operated with five cycles with the secondary pre-transfer charging performed by the primary pre-transfer charging device 46 or other charging device associated with the electrophotographic printing machine 10.

While the invention has been described with reference to the structure disclosed, it is not confined to the details set forth, but is intended to cover such modifications or changes as may come within the scope of the following claims. The invention is described with discharge are development and negatively charged toner but one of skill in the art readily recognizes the applicability of developer and charge arrangements of an electrophotographic machine. While preferred embodiments of the foregoing invention have been set fourth for purposes of illustration, the foregoing description should not be deemed to limitation on the invention herein. Accordingly, various modification, adaptations and alternatives may occur to one skilled in the art without departing from the spirit and scope of the present invention.

I claim:

1. A method for transfer of a toner image from a first toner support surface to a second toner support surface in a printing apparatus comprising:

forming a toner image on a first toner support surface;

applying a first preestablished charge to said toner image on said first toner support surface to form a first charged image;

applying a second preestablished charge less than said first preestablished charge to said first charged image to form a second charged image; and transferring said second charged image to a second toner support surface.

2. The method of claim 1 wherein said step of forming a toner image comprises:

applying a first toner layer onto said first toner support surface;

charging said first toner support surface having said first toner layer; and applying a second toner layer onto said first toner support surface to form said toner image.

3. The method of claim 1 wherein said first toner support surface is a photoreceptor and said step of forming a toner image comprises:

charging said first toner support surface;

exposing said first toner support surface to form a first latent image;

developing said first latent image with a first toner to form a first toner image;

recharging said first toner support surface;

re-exposing said recharged toner support surface to form a second latent image; and developing said second latent image with a second toner to form said toner image.

4. The method of claim 2 wherein said first toner layer is a first color and said second toner layer is a second color different from said first color.

5. The method of claim 1 wherein said toner image comprises a plurality of toners of different colors.

6. A method for transfer of a toner image from a photoreceptor to a toner support surface in a printing apparatus comprising:

charging said photoreceptor;

forming a first latent image on said charged photoreceptor;

applying a first toner layer onto said first latent image;

recharging said photoreceptor having said first toner layer;

forming a second latent image on said recharged photoreceptor;

applying a second toner layer onto said second latent image to form a toner image;

pre-transfer charging said toner image with a preestablished primary pre-transfer charge to form a primary pre-transfer charged toner image;

split charging said primary pre-transfer charged toner image with a split transfer charge to form a split charged toner image, said split transfer charge less than said primary pre-transfer charge; and transferring said split charged toner image to a toner support surface.

7. The method of transferring a toner image of claim 6 wherein said forming said first latent image comprises discharging said photoreceptor where said image is to be developed.

8. The method of transferring a toner image of claim 6 wherein said primary pre-transfer charge is about 200V greater than said split transfer charge.

9. The method of transferring a toner image of claim 6 wherein said primary pre-transfer charge is more than about 300V greater than said split transfer charge.

10. The method of claim 6 wherein said second toner layer overlaps said first toner layer.

11. A method of transferring an image from a photoreceptor to a toner support surface comprising:

forming a charged toner image on a photoreceptor, said toner image having a solid toner image area and a background toner image area:

selectively pre-transfer charging said solid toner image area to a first polarity;

selectively split transfer charging said background toner area to a second polarity opposite said first polarity; and transferring said toner image to the toner support surface.

12. The method of claim 11 wherein said toner support surface has a polarity the same as the second polarity.

13. The method of claim 12 wherein said selectively pre-transfer charging comprises charging substantially all of the toner image at a first preselected voltage, and subsequently charging substantially all the toner image to a second preselected voltage, said second preselected voltage less than said first preselected voltage.

14. The method of claim 12 wherein said pre-transfer charging is performed with a first charging device.

15. The method of claim 14 wherein said split transfer charging is performed with said first charging device.

16. The method of claim 14 wherein said split transfer charging is performed with a second charging device.

* * * * *